United States Patent [19]

Hinzmann

[11] Patent Number: 4,538,626

[45] Date of Patent: Sep. 3, 1985

[54] APPARATUS FOR TRIMMING A TOBACCO STREAM

[75] Inventor: Alfred Hinzmann, Weams, Va.

[73] Assignee: Hauni-Werke Körber & Co. KG., Hamburg, Fed. Rep. of Germany

[21] Appl. No.: 483,371

[22] Filed: Apr. 8, 1983

[51] Int. Cl.[3] ..... A24C 5/14

[52] U.S. Cl. ..... 131/84.4

[58] Field of Search ..... 131/84 C

[56] References Cited

FOREIGN PATENT DOCUMENTS 2949494 6/1981 Fed. Rep. of Germany .... 131/84 C
2001518 2/1979 United Kingdom ..... 131/84 C

*Primary Examiner*—V. Millin
*Attorney, Agent, or Firm*—Peter K. Kontler

[57] ABSTRACT

The tobacco stream trimming apparatus of a cigarette making machine has one or more discs which are driven at a peripheral speed exceeding the speed of movement of the tobacco stream through the trimming station. This results in a pronounced increase of the quality of cigarettes, especially dense-end cigarettes, because the pockets which are provided on the discs for the making of dense-end cigarettes penetrate into the tobacco stream and leave the tobacco filler without affecting the distribution of tobacco particles. The discs are driven by the main prime mover of the machine through the medium of an infinitely variable speed transmission whose ratio is adjustable by a servomotor in response to signals which are generated by a device that monitors the density of successive increments of the cigarette rod.

12 Claims, 3 Drawing Figures

APPARATUS FOR TRIMMING A TOBACCO STREAM

CROSS-REFERENCE TO RELATED CASE

The trimming apparatus of the present invention is similar to that disclosed in the commonly owned copending patent application Ser. No. 144,028 filed by Uwe Holznagel on Apr. 28, 1980 for "Apparatus for making fillers for rod-shaped smokers' products having dense ends".

BACKGROUND OF THE INVENTION

The present invention relates to machines for the production of cigarettes, cigars, cigarillos and analogous rod-shaped tobacco-containing articles wherein a tubular wrapper surrounds a filler of natural, reconstituted and/or imitation tobacco. More particularly, the invention relates to improvements in apparatus which are used in such machines to convert a continuous stream of tobacco particles into a continuous filler by removing the surplus of tobacco so that the resulting filler is ready for draping into a web of cigarette paper or the like.

The following description will deal with the production of cigarettes; however, it is to be understood that the invention can be embodied with equal advantage in machines which are used for the production of cigars, cigarillos, cheroots and/or other tobacco-containing products of the type wherein a tobacco filler is surrounded by a web of cigarette paper, reconstituted tobacco, tobacco leaves or the like.

It is known to produce cigarettes by resorting to a machine wherein a so-called distributor continuously converts a mass of tobacco particles into a stream which contains a surplus of tobacco. The stream is thereupon equalized by a trimming apparatus which is adjacent to the path of lengthwise movement of the stream and can comprise one or more rapidly rotating members which shear off the surplus and thus convert the stream into a rod-like filler which is ready for compacting and draping into cigarette paper or the like. As a rule, the distributor comprises means for showering or drawing particles of tobacco into a channel whose bottom wall is constituted by a foraminous belt conveyor which travels along the open side of a suction chamber so that it attracts the oncoming particles and converts them into a growing tobacco stream. The stream adheres to the conveyor by suction and is transported past the trimming or equalizing apparatus to be converted into the aforementioned filler. The trimming apparatus can comprise one or more rotary disc-shaped surplus removing or filler separating elements which can cooperate with a brush or a like separating tool serving to remove those portions of tobacco particles which extend from the channel beyond the plane of the surplus removing elements. Each disc-shaped surplus removing element normally extends to the central portion of the channel, i.e., to a plane which halves the channel and extends in the direction of tobacco transport toward the surplus removing location.

The just discussed trimming or equalizing apparatus operates quite satisfactorily if the speed of the tobacco stream is below a certain value. However, and since the trend in the manufacture of cigarettes is to increase the output practically from year to year, the conventional trimming apparatus are incapable of ensuring adequate equalization of a tobacco stream advancing at a speed which is required to produce at least, but preferably well in excess of, 7000 cigarettes per minute. Thus, the quality of cigarettes which are produced at the rate of appreciably in excess of 100 per second deteriorates with increasing output of the machine, and the deterioration can be traced directly to the operation or influence of the trimming apparatus.

OBJECTS AND SUMMARY OF THE INVENTION

An object of the invention is to provide a novel and improved tobacco stream trimming or equalizing apparatus which can be used in modern high-speed cigarette making or the like machines as a superior substitute for heretofore known trimming apparatus.

Another object of the invention is to provide a trimming apparatus which operates satisfactorily irrespective of the speed of the tobacco stream which is to be relieved of the surplus.

A further object of the invention is to provide a machine which embodies the aforementioned improved trimming or equalizing apparatus.

An additional object of the invention is to provide novel and improved means for driving the mobile component or components of the improved trimming apparatus.

Still another object of the invention is to provide a novel and improved method of removing the surplus from a rapidly advancing tobacco stream which is to be converted into a rod-like filler.

An additional object of the invention is to provide a trimming apparatus which does not adversely influence the consistency of the tobacco stream regardless of the speed at which the stream is transported past the trimming station.

Another object of the invention is to provide a trimming apparatus which embodies some or all of the above outlined features but is neither bulkier nor more expensive than heretofore known trimming apparatus.

The invention is embodied in an apparatus for removing the surplus of tobacco or like fibrous material from a continuous stream of fibrous material, particularly a stream which is produced by the distributor of a cigarette making or like machine. The apparatus comprises conveyor means for moving the stream lengthwise, surplus segregating means comprising at least one rotary disc having a marginal portion extending into the moving stream so that the surplus of fibrous material extends beyond one side of the disc, means for driving the conveyor means at a first speed (such first speed can vary from time to time), and means for imparting to the disc a peripheral speed which exceeds the first speed, preferably in such a way that, on penetration into the stream, successive increments of the peripheral portion of the disc have a component of movement extending in the direction of travel of the stream and corresponding to the speed of the stream and the conveyor means. The apparatus preferably further comprises means defining an elongated channel for the stream. The channel has an open side and the disc overlies the open side of the channel, preferably in such a way that it extends substantially to the center of the channel.

The apparatus preferably further comprises a servomotor or analogous means for varying the ratio of the speed of the conveyor means to the peripheral speed of the disc. To this end, the speed imparting means preferably comprises a variable speed transmission whose ratio is variable by the servomotor. The means for driving the conveyor means preferably comprises the main prime mover of the machine which embodies the improved apparatus, and such prime mover preferably transmits torque to the input means of the variable speed transmission. The control means for the servomotor can receive signals from a device (e.g., a beta ray detector) which monitors the density of the rod which is obtained by draping the trimmed stream (filler) into a web of cigarette paper or the like.

The surplus segregating means can comprise a pair of mirror symmetrically mounted coplanar discs whose marginal portions extend into the moving stream from the opposite sides of the stream and which are nearest to one another substantially at the center of the stream, i.e., at the center of the aforementioned channel for the stream. The segregating means can further comprise at least one rotary separating tool (e.g., a cylindrical brush or a wheel with teeth at its peripheral surface) which serves to remove the surplus of fibrous material extending beyond the one side of each of the two discs.

The marginal portion of each disc can be provided with at least one pocket, and the pockets of the two discs register with one another while in contact with the stream of fibrous material to thus reduce the amount of fibrous material which is removed from the respective portion of the stream. This is desirable in connection with the making of dense-end cigarettes. If the marginal portion of each disc has several pockets, such pockets are equidistant from one another, as considered in the circumferential direction of the respective disc, and successive pockets of one disc register with successive pockets of the other disc while such pockets extend into the tobacco stream. The spacing between the pockets of each disc, as considered in the circumferential direction of the respective discs, exceeds the length of a discrete cigarette which is produced in the machine embodying the improved apparatus, preferably to an extent which is proportional to the difference between the speed of lengthwise movement of the tobacco stream and the peripheral speed of the discs.

The novel features which are considered as characteristic of the invention are set forth in particular in the appended claims. The improved trimming apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
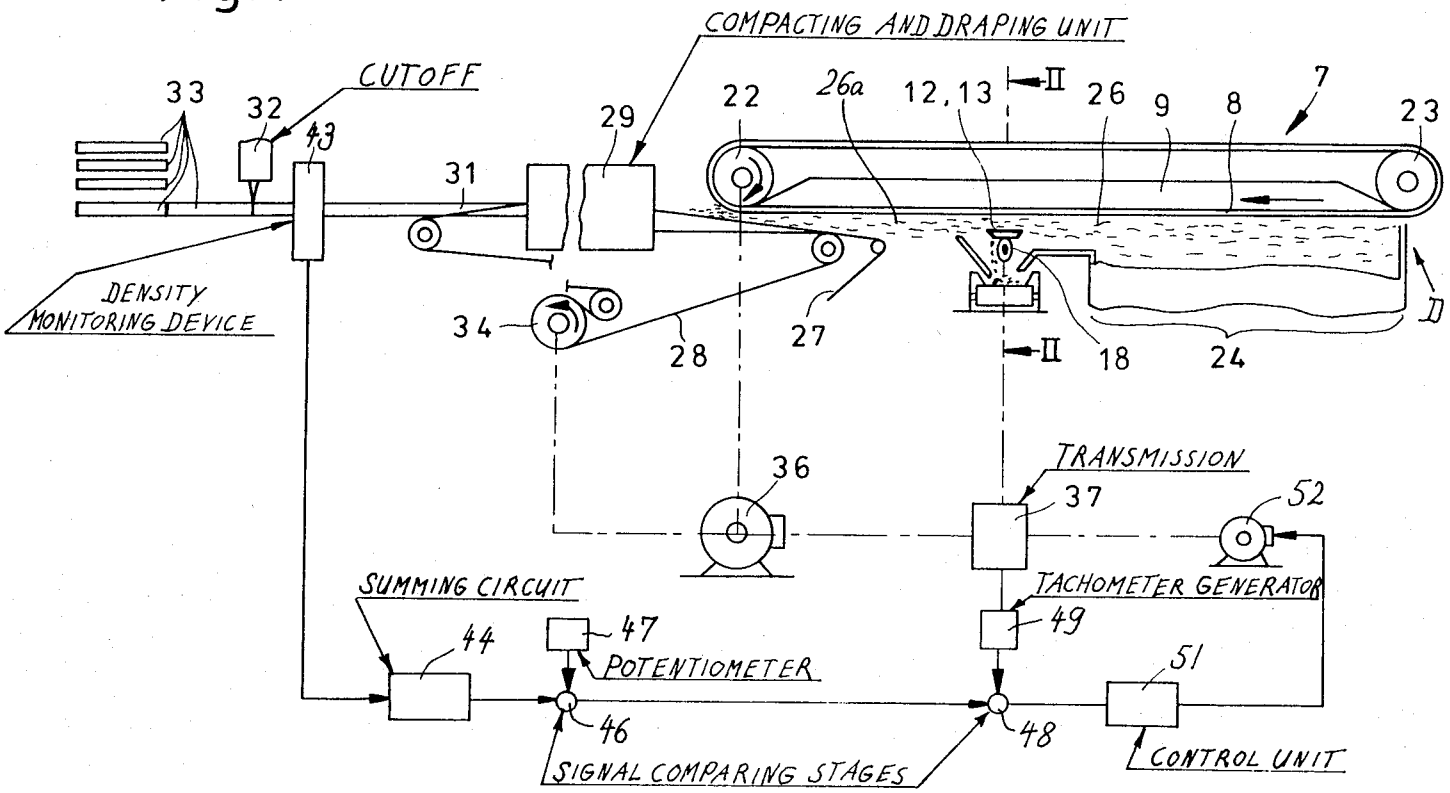
FIG. 1 is a fragmentary partly longitudinal vertical sectional and partly diagrammatic view of a cigarette rod making machine embodying a trimming apparatus which is constructed, assembled and operated in accordance with the invention.

The drawing shows a portion of a cigarette making machine, e.g., a machine of the type known as Garant or Prothos (both manufactured and sold by the assignee of the present application). The distributor of the machine comprises an upwardly extending duct D which supplies a shower of tobacco particles into an elongated horizontal or nearly horizontal channel 1 flanked by two elongated parallel sidewalls 2, 3 and an elongated top wall 8 constituting the lower reach of a foraminous endless belt conveyor 7 trained over spaced-apart pulleys 22 and 23. The rate at which the particles of tobacco are supplied by the duct D is such that the underside of the lower reach 8 of the conveyor 7 accumulates a tobacco stream 26 whose height exceeds the height of the filler (26*a*) which is to be draped into a web 27 of cigarette paper or other suitable wrapping material. The lower reach 8 of the conveyor 7 advances below the perforated bottom wall 6 of an elongated suction chamber 9 which attracts the particles of tobacco to the underside of the lower reach 8 where the particles form a substantially wedge-like growing stream. The holes of the bottom wall 6 are shown at 4. The fully grown stream 26 is transported in a direction to the left, as viewed in FIG. 1, i.e., away from the observer of FIG. 2.

Figure 2:
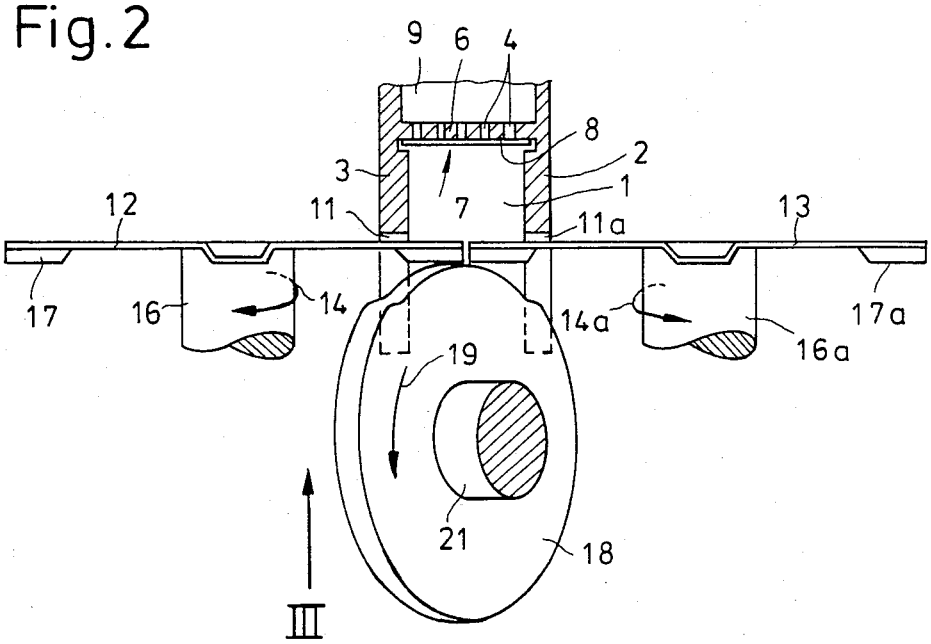
FIG. 2 is an enlarged transverse vertical sectional view as seen in the direction of arrows from the line II—II of FIG. 1.
Figure 3:
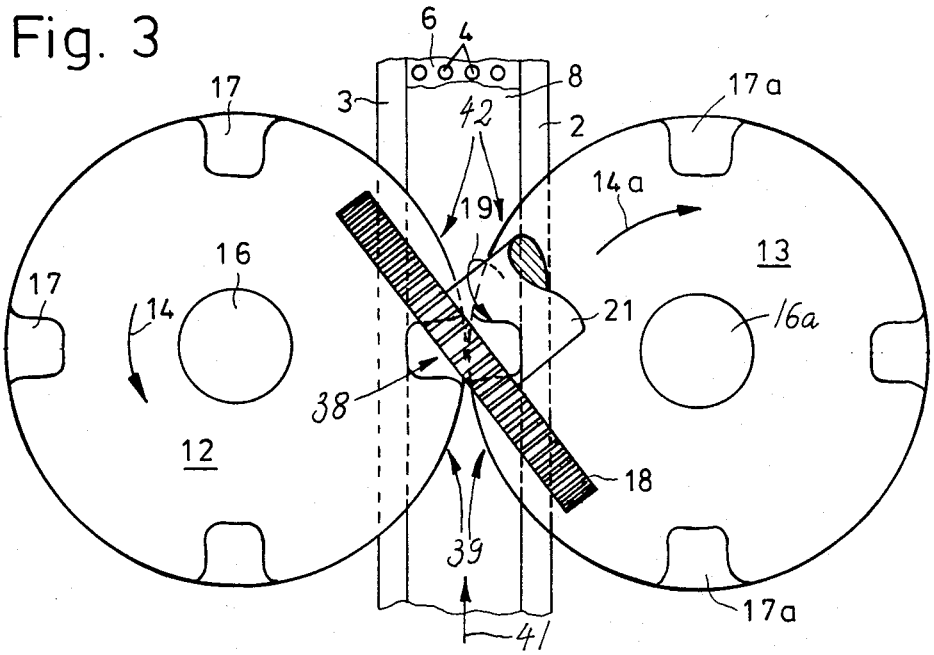
FIG. 3 is a bottom plan view as seen in the direction of arrow III in FIG. 2.

The trimming or equalizing station of the cigarette making machine is located downstream of the duct D at a level below the lower reach 8 of the conveyor 7 in a region where the suction chamber 9 continues to attract the fully grown stream 26 to the underside of the conveyor. The surplus segregating means of the trimming apparatus at such station comprises two mirror symmetrical rotary tobacco engaging and retaining discs 12 and 13 having portions which extend through the cutouts 11, 11*a* of the respective sidewalls 3, 2 and into the channel 1. As shown in FIGS. 2 and 3, the preferably sharp marginal portions of the discs, 12, 13 are in contact with or very close to each other in a plane which is disposed midway between and is parallel to the sidewalls 2 and 3. The discs 12 and 13 are driven in the directions which are respectively indicated by the arrows 14 and 14*a*, i.e., the disc 13 rotates clockwise and the disc 12 rotates counterclockwise, as viewed as FIG. 3. The plane of the discs 12 and 13 is parallel or nearly parallel to the plane of the lower reach 8 of the conveyor 7. The means for transmitting torque to the discs 12 and 13 comprises shafts 16 and 16*a* which are journalled in the frame of the cigarette making machine. The marginal portions of the discs 12 and 13 are provided with equidistant pockets 17 and 17*a* whose purpose is to ensure that certain portions of the tobacco filler 26*a* contain more tobacco than the remaining portions; this is necessary if the machine is designed to produce so-called dense-end cigarettes which reduce the likelihood of uncontrolled escape of tobacco particles at the open ends of the wrappers. The distance between the bottom walls of the pockets 17 and 17*a* and the reach 8 of the conveyor 7 exceeds the distance between this reach and the major portions of the discs 12 and 13.

The discs 12 and 13 cooperate with a tobacco removing or separating wheel 18 which acts not unlike a milling tool and separates the fragments of tobacco exending below the plane of the discs 12 and 13. The thickness (axial length) of the wheel 18 is less than the width of the channel 1, and this wheel is driven by a shaft 21 which is rotated in the direction of arrow 19. The plane of the wheel 18 is normal to the plane of the lower reach 8 of the conveyor 7. The shaft 21 is driven at a constant speed by a discrete prime mover, not shown. The wheel 18 can be replaced with a rotary brush.

The width 24 of the discharge end of the duct D, which delivers tobacco particles to the underside of the lower reach 8 of the conveyor 7, corresponds to the length of the tobacco growing zone wherein the height of the tobacco stream increases from zero to a height which exceeds the diameter of the tobacco filler. The fully grown stream 26 advances with the lower reach 8 toward the equalizing station, i.e., into the range of the rotating discs 12, 13 and wheel 18. The marginal portions of the discs 12 and 13 clamp the downwardly extending particles of tobacco substantially centrally of the channel 1, and such marginal portions can also perform at least some cutting or severing action. The particles (e.g., shreds), which are not severed by the marginal portions of the discs 12 and 13 are severed by the inclined teeth at the periphery of the wheel 18.

Successive pockets 17, 17*a* of the discs 12 and 13 register at the center of the channel 1 and ensure that the corresponding portions of the filler 26*a* contain more tobacco. The spacing between such portions equals the length of a cigarette 33. As can be seen in FIG. 2, the configuration of the peripheral portion of the wheel 18 is selected in such a way that the teeth of this wheel can remove tobacco particles which extend downwardly beyond the major parts of the marginal portions of the discs 12, 13 as well as tobacco particles which extend downwardly beyond the registering pockets 17 and 17*a*. If the cigarettes 33 which are produced in the machine embodying the structure of FIGS. 1 to 3 need not be provided with dense ends, the discs 12 and 13 are replaced with discs which are without pockets.

The filler 26*a* which is formed at the trimming station, and wherein elongated portions which contain smaller quantities of tobacco alternate with relatively short portions containing more tobacco, is thereupon advanced toward and onto the web 27 of the cigarette paper which is drawn from a bobbin and is caused to contact the upper side of the upper reach of a garniture belt 28. Successive increments of the web 27 and filler 26*a* are caused to pass through a combined compacting and draping unit 29 wherein the web 27 is draped around the filler 26*a* and the latter is condensed so that its diameter is constant throughout in spite of the fact that certain of its portions contain more tobacco than the others. The overlapping marginal portions of the draped web 27 are bonded to each other to form a seam, and the resulting cigarette rod 31 is severed in a cutoff 32 to yield a file of discrete plain cigarettes 33 of unit length or multiple unit length.

The garniture belt 28 is driven by a pulley 34 which receives torque from the main prime mover 36 of the cigarette making machine. The prime mover 36 also transmits torque to the front pulley 22 for the conveyor 7.

In heretofore known cigarette making machines which employ a trimming apparatus of the type shown in FIGS. 2 and 3, the discs (actually their shafts) are connected with the output element of the main prime mover by a rigid torque transmitting unit which ensures that the peripheral speed of each disc always matches the speed of lengthwise movement of the tobacco stream. In accordance with a feature of the present invention, the connection between the output element of the main prime mover 36 (e.g., a variable-speed electric motor) and the shafts 16, 16*a* comprises an infinitely variable speed transmission 37 whose ratio can be varied by a servomotor 52. The transmission 37 is a step-up transmission, i.e., the peripheral speed of the discs 12, 13 exceeds the speed of forward movement of the stream 26 toward, past and beyond the trimming station. In other words, the peripheral speed of the discs 12 and 13 exceeds the speed of the conveyor 7. This ensures that the peripheral speed of the discs 12 and 13 has a component in the direction (arrow 41 in FIG. 3) of movement of the stream 26 and matching the speed of the stream in such direction. The just mentioned component of the peripheral speed develops in the region 39, i.e., ahead of the location (38) where the teeth of the wheel 18 remove downwardly extending portions of tobacco particles at the undersides of the marginal portions of the two discs. Successive increments of the marginal portions of the discs 12, 13 advance through the respective cutouts 11, 11*a* and into the stream 26 which advances with the lower reach 8 of the conveyor 7 toward the tobacco severing location 38. The situation is analogous downstream of the location 38 (in the region 42 shown in FIG. 3) where successive increments of the marginal portions of the discs 12, 13 move gradually away from the center of the channel 1 and toward the respective cutouts 11, 11*a* to become disengaged from the particles of the filler 26*a*.

The just discussed mode of selecting the peripheral speed of the discs 12 and 13 ensures that the pockets 17 and 17*a* can be filled with tobacco (in the region 39) without causing appreciable or any shifting of tobacco particles which form the stream 26. The filling of the pockets 17, 17*a* with tobacco is gradual, uniform and predictable. In the region 39, the pockets 17, 17*a* move away from positions of overlap with the underside of the channel 1 without entraining tobacco particles into the cutouts 11, 11*a* and away from the filler 26*a*. It has been found that the aforementioned novel mode of driving the discs 12, 13 at a peripheral speed which exceeds the speed of lengthwise movement of the conveyor 7 ensures the making of cigarettes with dense ends which are of much higher quality than if the peripheral speed of the discs were to match the speed of the conveyor 7.

As mentioned above, the ratio of the step-up transmission 37 for the shafts 16, 16*a* of the respective discs 12, 13 is infinitely variable by the servomotor 52. The servomotor 52 forms part of an adjusting circuit which further includes a monitoring device 43 (e.g., a conventional beta ray detector) which is adjacent to the path of movement of the cigarette rod 31 and monitors the density of successive increments of the condensed filler 26*a*, i.e., of the filler whose diameter is constant because it is already draped into and confined in the web 27. The monitoring device 43 can comprise a source of corpuscular radiation at one side of the path of movement of the cigarette rod 31 and a transducer (e.g., an ionization chamber) at the other side of such path opposite the source. Signals which are generated by the transducer of the monitor device 43 are transmitted to the input of a summing circuit 44 whose output signal is used to regulate the peripheral speed of the discs 12 and 13 in a sense to ensure that the average density of the filler 26*a* in the rod 31 and especially the density of denser portions of the filler remains constant and matches an optimum density. The signal at the output of the summing circuit 44 is indicative of the average density of selected lengths of the filler 26*a* in the rod 31, and such signal is transmitted to a signal comparing stage 46 which compares the output signal of the summing circuit 44 with a reference signal transmitted by an adjustable potentiometer 47 or another suitable source and denoting the desired average density of the filler. The signal at the output of the signal comparing stage 46 is transmitted to one input of a second stage 48 another input of which receives a signal denoting the momentary ratio of the transmission 37, i.e., the momentary or actual peripheral speed of the discs 12 and 13. Such signal is furnished by a tachometer generator 49 or any other suitable RPM detector. If the intensity or another characteristic of the signal which is transmitted by the output of the stage 46 deviates from the corresponding characteristic of the signal which is transmitted by the tachometer generator 49, the output of the stage 48 transmits a signal to a control unit 51 which causes the servomotor 52 to change the ratio of the transmission 37. The ratio is changed in a sense to ensure that the ensuing change of the peripheral speed of the discs 12, 13 with reference to the speed of the conveyor 7 causes the tachometer generator 49 to transmit an output signal which cancels the output signal of the stage 46 so that the servomotor 52 ceases to change the ratio of the transmission 37. The just discussed components of the circuitry shown in the lower part of FIG. 1 are commercially available devices the exact construction of which forms no part of the present invention. The same applies for the motors 36, 52 and transmission 37. The change of ratio of the transmission 37 entails a change in the intensity of signal which is transmitted by the transducer of the monitoring device 43 so that the signal at the output of the summing circuit 44 matches the reference signal which is transmitted by the potentiometer 47 whereby the stage 46 ceases to transmit a signal as long as the density of the compacted filler **26*a* in the rod 41** remains satisfactory.

The servomotor 52 and the means for starting and arresting this motor constitute an optional but highly desirable feature of the improved apparatus. Thus, the ratio of the transmission 37 can remain constant, as long as the transmission ensures that the peripheral speed of the discs 12, 13 exceeds the speed of the conveyor 7. However, the provision of an infinitely variable speed transmission renders it possible to change such ratio when the speed of the main prime mover 36 is changed because such change of the speed of the prime mover 36 often necessitates or can necessitate the selection of a different ratio between the peripheral speed of the discs 12, 13 and the speed of lengthwise movement of the stream 26 past the trimming station. Moreover, the ratio of the transmission 37 can require a change (in order to ensure that the density of compacted filler **26*a* in the rod 31 will not deviate from the optimum value) if the machine begins to receive a different tobacco brand or mixture of tobacco brands, if the condition of tobacco particles (e.g., their moisture content)changes, and/or if the speed of the conveyor 7** changes.

In conventional trimming or equalizing apparatus, the peripheral speed of the disc or discs conforms to the speed of lengthwise movement of the tobacco stream. Therefore, the spacing between neighboring pockets of the disc or discs corresponds to mutual spacing of successive densified portions of the filler in the cigarette rod (the knife or knives of the cutoff 32 can sever the rod across or adjacent to the densified portions of the confined filler, depending upon whether one or both ends of each cigarette should be densified). In the improved trimming apparatus, the diameters of the discs 12, 13 exceed the diameters of discs in conventional apparatus to an extent which is a function of the difference between the peripheral speed of such discs and the speed of the conveyor 7. Furthermore, the spacing between the neighboring pockets 17 of the discs 12 and the neighboring pockets **17*a* of the disc 13 is increased, again as a function of the difference between the peripheral speed of the discs and the speed of lengthwise movement of the lower reach 8 of the conveyor 7**.

As mentioned above, actual tests with the improved trimming device indicate that the quality of the cigarettes is improved to a surprising degree by the simple expedient of increasing the peripheral speed of the discs 12, 13 in the aforediscussed manner. The improvement was dramatic in the quality of those portions of the rod 31 which constitute the end portions of discrete cigarettes 33, i.e., which constitute the dense ends of such cigarettes. This is attributed to the fact that the penetration of pockets **17, 17*a* into the stream 26 and withdrawal of pockets from contact with the filler 26*a* does not entail any, or any appreciable, changes in the consistency of the stream and filler, i.e., that the pockets 17, 17*a* do not disturb the distribution of tobacco particles in the region 39 and/or in the region 42 shown in FIG. 3**.

A distributor of the type which can be used to produce the stream 26 is disclosed in the commonly owned U.S. Pat. Nos. 3,996,943 and 3,996,944 granted Dec. 14, 1976 to Alfred Hinzmann. Reference may also be had to commonly owned U.S. Pat. Nos. 4,280,516, (granted July 28, 1981), 4,284,087 (granted Aug. 18, 1981) and 4,290,436 (granted Sept. 22, 1981) to Joachim Reuland which disclose portions of similar cigarette making machines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for removing the surplus of tobacco or like fibrous material from a continuous stream, comprising conveyor means for moving the stream lengthwise; surplus segretating means comprising at least one rotary disc having a marginal portion extending into the moving stream so that the surplus of fibrous material extends beyond one side of the disc; means for driving said conveyor means at a first speed; means for imparting to said disc a peripheral speed exceeding said first speed; and means for varying the ratio of the speed of said conveyor means to the peripheral speed of said disc.

2. The apparatus of claim 1, further comprising means defining an elongated channel for the stream, said channel having an open side and said disc overlying the open side of the channel.

3. The apparatus of claim 2, wherein said disc extends substantially to the center of said channel.

4. The apparatus of claim 1, wherein said speed imparting means comprises a variable speed transmission and said varying means comprises means for changing the ratio of said transmission.

5. The apparatus of claim 4, wherein said ratio changing means comprises a servomotor.

6. The apparatus of claim 4, wherein said means for driving said conveyor means comprises a prime mover and said transmission has input means driven by said prime mover.

7. The apparatus of claim 4, further comprising control means for said ratio changing means.

8. The apparatus of claim 1, wherein said surplus segregating means comprises a pair of discs having marginal portions extending into the moving stream from the opposite sides of each stream and being nearest to each other substantially at the center of the stream.

9. The apparatus of claim 8, wherein said segregating means further comprises a rotary separating tool arranged to remove the fibrous material extending beyond said one side of each of said discs.

10. The apparatus of claim 8, wherein the marginal portion of each of said discs has at least one pocket and such pockets register while in contact with the stream to thus reduce the amount of fibrous material which is removed from the respective portion of the stream.

11. In a machine for the production of cigarettes or analogous rod-shaped articles having a predetermined length, apparatus for moving the surplus of tobacco or like fibrous material from a continuous stream, comprising conveyor means for moving the stream lengthwise; surplus segregating means comprising a pair of discs disposed at the opposite sides of the conveyor means and having marginal portions extending into the moving stream from the respective sides of the conveyor means so that the surplus of fibrous material extends beyond one side of each of said discs, the marginal portion of each of said discs having a plurality of equidistance pockets; means for driving said conveyor means at a first speed; means for imparting to said discs a peripheral speed exceeding said first speed, successive pockets of one of said discs registering with successive pockets of the other of said discs while the respective pockets contact the stream to thus reduce the amount of fibrous material which is removed from the respective portion of the stream, the spacing between the pockets of each of said discs, as considered in the circumferential direction of the respective discs, exceeding said predetermined length; and means for varying the ratio of said peripheral speed to said first speed.

12. The apparatus of claim 11, wherein each of said discs has at least three equidistant pockets.

* * * * *